US005732755A

United States Patent [19]

Cross

[11] Patent Number: 5,732,755

[45] Date of Patent: Mar. 31, 1998

[54] DOUBLE TRACK AWNING FABRIC MOUNTING STRIP

[76] Inventor: Miles P. Cross, N 7954 490th St., Spring Valley, Wis. 54767

[21] Appl. No.: 669,960

[22] Filed: Jun. 25, 1996

[51] Int. Cl.[6] ..... E04F 10/02

[52] U.S. Cl. ..... 160/57; 160/392

[58] Field of Search ..... 160/57, 391, 392, 160/395; 52/63, 74, 222, 656.1, 658; 135/117

[56] References Cited

U.S. PATENT DOCUMENTS

| | | | |
|---|---|---|---|
| 2,396,026 | 3/1946 | Smith | 160/57 |
| 2,578,737 | 12/1951 | Powers | 160/392 |
| 2,829,711 | 4/1958 | Hiller | 160/57 |
| 3,143,165 | 8/1964 | Lewis et al. | 160/392 X |
| 3,875,623 | 4/1975 | Johnston | 160/392 X |
| 3,991,806 | 11/1976 | Abell | 160/392 X |
| 4,233,790 | 11/1980 | Meadows | 160/395 X |
| 4,690,192 | 9/1987 | Stilling | 160/57 |
| 5,209,029 | 5/1993 | Foerst | 160/392 X |
| 5,540,476 | 7/1996 | Cowsert | 160/392 X |

*Primary Examiner*—David M. Purol

*Attorney, Agent, or Firm*—Jacobson and Johnson

[57] ABSTRACT

A double channel mounting strip is provided for a fabric-covered awning with a beaded end of the covering fabric secured in place in one of the channels and a beaded end of a flap fabric is held in place in the other channel so that the flap hangs down in a uniform and smooth unruffled fashion when the covering fabric is pulled taut on the awning mounting frame.

2 Claims, 3 Drawing Sheets

12
12B
12A
13
10
11
11
11
16
11
11
11
11
16
14
17
14
18
11
16
17
14
15
14
15
18

DOUBLE TRACK AWNING FABRIC MOUNTING STRIP

FIELD OF THE INVENTION

The invention is directed for use in the construction and assembly of fabric-covered awnings which are mounted on buildings or structures. Specifically, the invention is directed toward a double channel mounting strip for holding a beaded end of the covering awning fabric in tension and a beaded end of the awning flap fabric.

DESCRIPTION OF THE PRIOR ART

U.S. Pat. No. 2,547,692 shows a looped end of an awning fabric held in place by a shallow channel formed by a curved lip and U.S. Pat. No. 2,423,402 illustrates a mounting strip having a flange portion for attaching it to a supporting structure and a single channel for receiving and holding the beaded end of an awning fabric. In many instances, especially where the awning is designed to be decorative in appearance, a short length or flap of fabric extends downward from the mounting strip. It has been found that when a single channel such as illustrated in the aforementioned patents, is used, when the fabric is pulled taut and secured in place to the mounting frame the flap becomes somewhat distorted which detracts from the appearance of the awning.

SUMMARY OF THE INVENTION

An elongated metal mounting strip is provided with a flange for attaching the mounting strip to the awning fabric mounting frame and has a pair of parallel channels integrally formed with the flange. One channel receives and holds the splined or beaded end of the awning fabric which is stretched and pulled taut over the awning mounting frame and the other channel receives and holds the splined beaded end of a short length of fabric which extends downward from the front edge of the awning mounting frame to form a flap. Since the fabrics are suspended independently from separate channels, when the fabric covering the mounting frame is pulled taut the flap does not distort thereby presenting a neat appearing awning when mounted in place.

DESCRIPTION OF THE PREFERRED EMBODIMENTS

Figure 1:
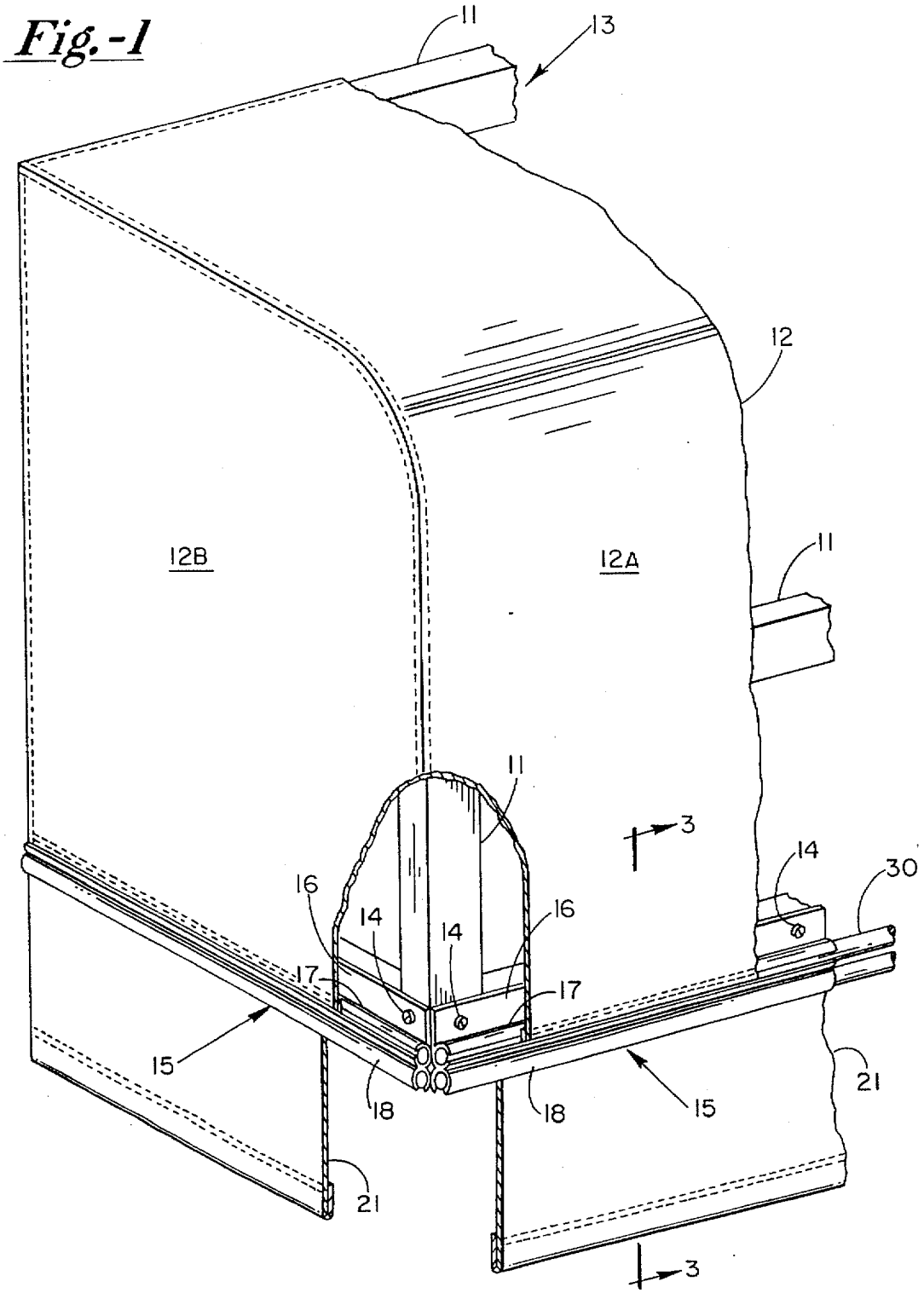
FIG. 1 is a breakaway somewhat simplified illustration of a preferred embodiment of the invention in place and in use in an assembled awning.
Figure 2:
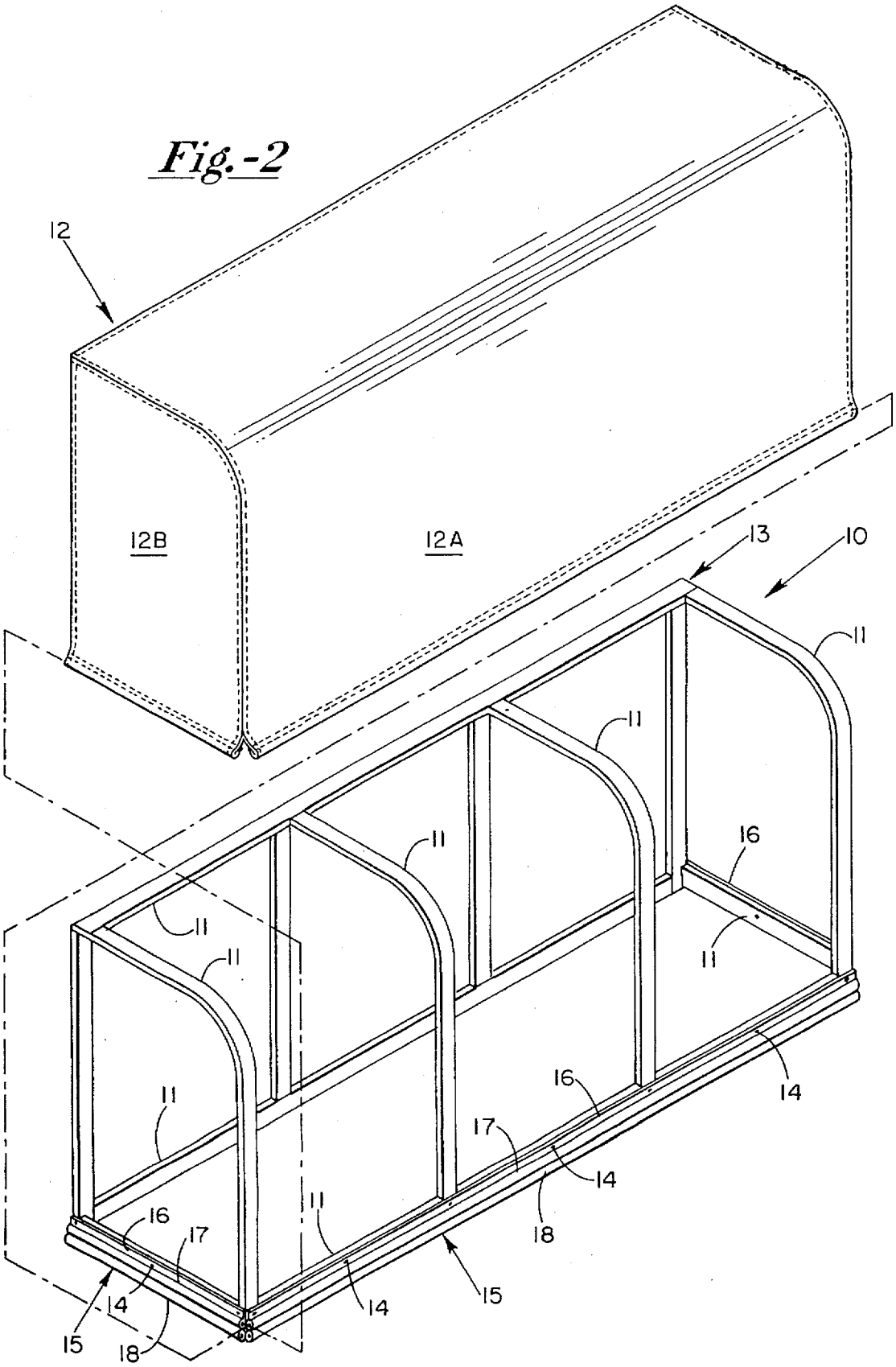
FIG. 2 shows a typical fabric covering for an awning and an associated support frame.
Figure 3:
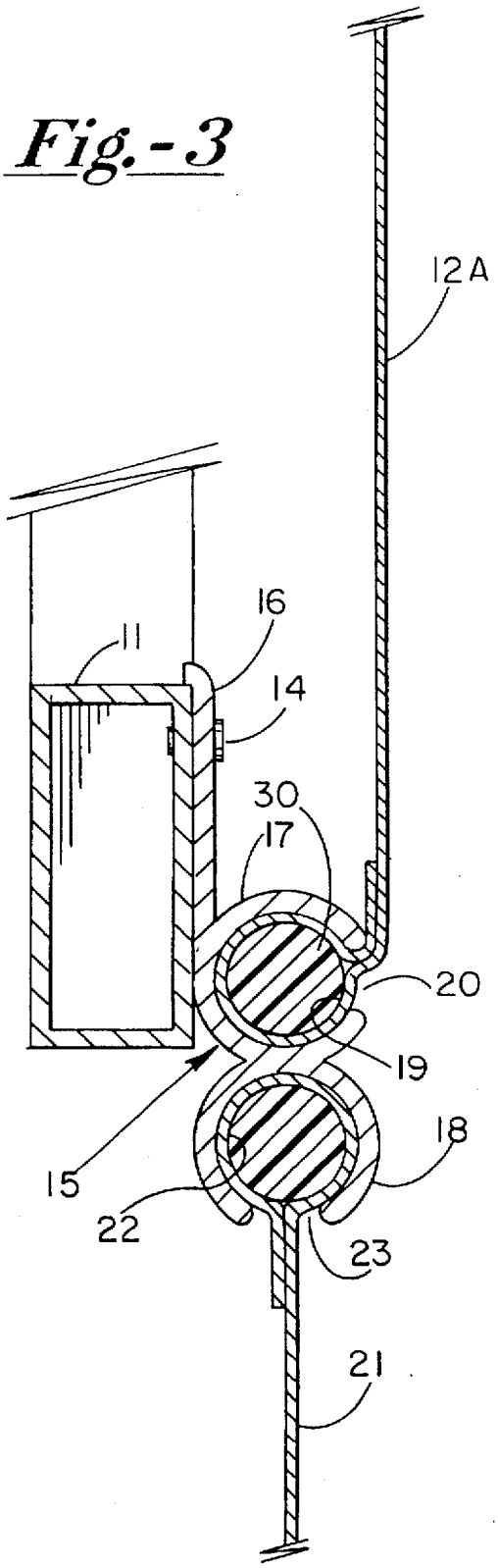
FIG. 3 is a sectioned view illustrating the fabric in place in the mounting strip and the mounting strip attached to the awning support frame.

Typically and conventionally a fabric awning support frame, identified generally by reference numeral 10, comprises a number of rigid rectangular tubular members 11 which are securely joined together in some conventional fashion, such as by welding or bolting, to provide a rigid support for a conventional covering awning fabric 12 having a top and front panel 12A and side panels 12B. The rear of mounting frame 10, designated by reference numeral 13, is usually attached in some convenient and conventional fashion to a structure such as a building (not shown) which may house a restaurant or a store or the like. Secured to the lower front and sides of mounting frame 10 such as by screws or rivets 14 or by welding are fabric mounting strips 15 which extend across the front or width and side or depth of mounting frame 10. Mounting strips 15 each comprise a flange section 16 for mounting or attaching the mounting strip to support frame 10, an integrally formed upper C-shaped channel 17 and lower C-shaped channel 18.

A splined or beaded end 19 of top panel 12A of awning covering fabric 12 is inserted into channel 17 of mounting strip 15 the length of the mounting strip (or width of support frame 10) so that the fabric extends and covers over the entire top area of frame 10. Typically and conventionally, the bead or spline may be formed by placing a tube or cord 30 of extruded polyfoam at the edge of the fabric and wrapping an edge of the fabric around the cord or tube and then sewing it closed, or by first making a tubular opening at the end of the fabric and then inserting the polyfoam cord 30. Alternatively, some suitable rope material might also be used. The covering fabric 12 extends out of channel 17 through the channel slit or opening 20 and, as shown in FIG. 1, extend rearward over frame 10. In conventional fashion panel 12A is pulled taut while the beaded edge 19 is secured in place in channel 17 so that it is in tension and is then secured in some typical and conventional fashion, not shown, generally at the rear of support frame 10. In a similar fashion splined or beaded ends of side panels 12B are inserted into channels 17 of mounting strips 15 which are attached, by screws or rivets 14 or by welding, to the lower ends of the sides of support frame 10. The side panels 12B are similarly pulled taut so that they are in tension and secured in some fashion (not shown) to mounting frame 10.

Another piece of fabric 21 similarly has a splined or beaded end 22 which typically is formed in the same fashion as the beaded end 19 of fabric 12 and is inserted into channels 18 with the fabric 12 exiting via channel slit or openings 23 and extends downward to form front and side untensioned flaps or skirts for the awning. When the covering fabric 12 is pulled taut and is secured in tension to frame 10, flap or skirt material 21 remains undisturbed so that it hangs down neatly and uniformly and does not detract from the appearance of the awning. Also the flap can be made of a different material or possibly different colored material. Also, in this fashion the awning flap can be replaced if desired without disturbing the rest of the awning, for example, to change graphics painted or printed on the flap.

While tensioning of the covering fabric 12 may be done in several ways, a preferred way is to use attached take-up lacing (not shown) which can be pulled taut and adjusted until the fabric appears perfect and then tied or otherwise secured in place.

I claim:

1. In combination:

an awning supporting frame attached at its rear to a supporting structure;

an awning mounting strip comprising an elongated rigid flange attached to the front end of said awning supporting frame and a pair of C-shaped elongated channels integrally formed with said flange;

one of said channels holding a beaded end of an awning covering fabric, said fabric covering over the flange and said awning supporting frame and secured tightly at the rear of said supporting frame; and the other of said channels holding a beaded end of a free hanging awning fabric flap, said fabric flap hanging downward from said other channel so that tensioning of the covering fabric does not distort the flap.

2. The combination as described in claim 1 wherein the opening in one of said C-shaped channels faces away from said flange and the opening in the other of said C-shaped channels faces downward from said flange whereby the awning covering fabric extends through the opening of said first-mentioned channel and over the flange and the supporting frame.

* * * * *